US008579614B2

(12) United States Patent
Sun

(10) Patent No.: US 8,579,614 B2
(45) Date of Patent: Nov. 12, 2013

(54) SCROLL COMPRESSOR WITH THREE DISCHARGE VALVES, AND DISCHARGE PRESSURE TAP TO BACK PRESSURE CHAMBER

(75) Inventor: Zlll Sun, Arkadelphia, AR (US)

(73) Assignee: Danfoss Scroll Technologies LLC, Arkadelphia, AR (US)

( * ) Notice: Subject to any disclaimer, the term of this patent is extended or adjusted under 35 U.S.C. 154(b) by 282 days.

(21) Appl. No.: 13/021,055

(22) Filed: Feb. 4, 2011

(65) Prior Publication Data

US 2012/0201707 A1 Aug. 9, 2012

(51) Int. Cl.

| | |
|---|---|
| ***F03C 4/00*** | (2006.01) |
| ***F04C 2/00*** | (2006.01) |
| ***F04C 18/00*** | (2006.01) |

(52) U.S. Cl.

USPC ..... 418/55.5; 418/15; 418/55.1; 418/57; 418/180; 418/270; 417/308; 417/310

(58) Field of Classification Search

USPC ..... 418/15, 55.1–55.6, 57, 180, 270; 417/299, 307, 308, 310

See application file for complete search history.

(56) References Cited

U.S. PATENT DOCUMENTS

| | | | | |
|---|---|---|---|---|
| 4,774,816 | A * | 10/1988 | Uchikawa et al. | 418/55.1 |
| 4,818,195 | A * | 4/1989 | Murayama et al. | 418/55.1 |
| 7,393,190 | B2 * | 7/2008 | Lee et al. | 418/55.1 |
| 2010/0028182 | A1 * | 2/2010 | Hahn | 418/55.1 |

FOREIGN PATENT DOCUMENTS

JP 62070681 A * 4/1987

* cited by examiner

*Primary Examiner* — Theresa Trieu

(74) *Attorney, Agent, or Firm* — Carlson, Gaskey & Olds, PC

(57) ABSTRACT

A scroll compressor has a housing enclosing a compressor pump unit which includes an orbiting scroll member and a non-orbiting scroll member. Each of the orbiting and non-orbiting scroll members include a base and a generally spiral wrap extending from the base. The wraps interfit to define compression chambers, with a central-most discharge pressure chamber, and circumferentially spaced intermediate pressure chambers being defined. The base of the non-orbiting scroll includes ports associated with the intermediate pressure chambers. At least one port is associated with the discharge pressure chamber. Valves are associated with each of the ports. A discharge plenum is defined downstream of the ports and valves within the housing. A back pressure chamber is defined behind the base of one of the orbiting and non-orbiting scroll members, and taps a refrigerant from the discharge pressure chamber.

3 Claims, 4 Drawing Sheets

SCROLL COMPRESSOR WITH THREE DISCHARGE VALVES, AND DISCHARGE PRESSURE TAP TO BACK PRESSURE CHAMBER

BACKGROUND

This application relates to a scroll compressor wherein there are three discharge valves arranged about distinct compression chambers, and wherein a back pressure chamber taps a refrigerant from a central full discharge compression chamber.

Scroll compressors are known, and typically include a pair of scroll members each having a base and a generally spiral wrap extending from the base. The two wraps interfit to define compression chambers. One of the two scroll members is caused to orbit relative to the other, and as the orbiting occurs, the compression chambers are reduced in volume, thereby compressing an entrapped refrigerant.

There are many challenges for scroll compressor designs. One challenge relates to a force tending to separate the wrap of each scroll compressor from the base of the other. The wraps must be maintained in sealing contact with the opposed base to maximize efficiency. However, the entrapped refrigerant does create a separating force.

To address the separating force, it is known to tap a partially compressed refrigerant to a back pressure chamber defined behind the base of one of the two scroll members. In practice, and for various reasons, it has typically been the case that the tap has been from an intermediate pressure chamber. There have been inefficiencies and concerns when a full discharge pressure refrigerant is tapped to the back pressure chamber.

Another feature which is known in scroll compressors is the use of a central discharge port associated with the discharge valve, but in addition, "over-pressure control valves." These valves are positioned slightly radially outwardly of the central discharge port, and these valves can open and allow the refrigerant to enter a discharge plenum. Generally, when these over-pressure valves open, then the compressor could be said to be operating at a low pressure ratio. At other times, the compressor may be operating at a high pressure ratio, and only the central port will open.

A refrigerant system designer would understand that a scroll compressor will self-regulate in combination with an associated refrigerant system to operate either in a low pressure ratio or high pressure ratio conditions.

In scroll compressors, there are many design concerns. One design concern could be called "over-shoot." Over-shoot occurs (see FIGS. 4A and B) when there is no provision of the over-pressure valves, and the refrigerant is compressed until it reaches the central compression chamber, at which time the discharge valve opens, and the refrigerant is now at a higher pressure than in the discharge pressure chamber. Thus, power is wasted to move the compressed refrigerant to that final compression chamber. The over-pressure valves as mentioned above, do address this concern.

However, another concern is backflow. When the refrigerant operates at the high pressure ratio, there is a concern that the compressed refrigerant, reaching a high pressure, can overcome the intermediate pressure refrigerant in the back pressure chamber, and cause the scroll members to separate. As shown in FIGS. 4B and 4C, one can understand the efficiency losses due to backflow and this concern.

SUMMARY

A scroll compressor has a housing enclosing a compressor pump unit which includes an orbiting scroll member and a non-orbiting scroll member. Each of the orbiting and non-orbiting scroll members include a base and a generally spiral wrap extending from the base. The wraps interfit to define compression chambers, with a central-most discharge pressure chamber, and circumferentially spaced intermediate pressure chambers being defined. The base of the non-orbiting scroll includes ports associated with the intermediate pressure chambers. At least one port is associated with the discharge pressure chamber. Valves are associated with each of the ports. A discharge plenum is defined downstream of the ports and valves within the housing. A back pressure chamber is defined behind the base of one of the orbiting and non-orbiting scroll members, and taps a refrigerant from the discharge pressure chamber.

These and other features of the present invention can be best understood from the following specification and drawings, the following of which is a brief description.

DETAILED DESCRIPTION

Figure 1:
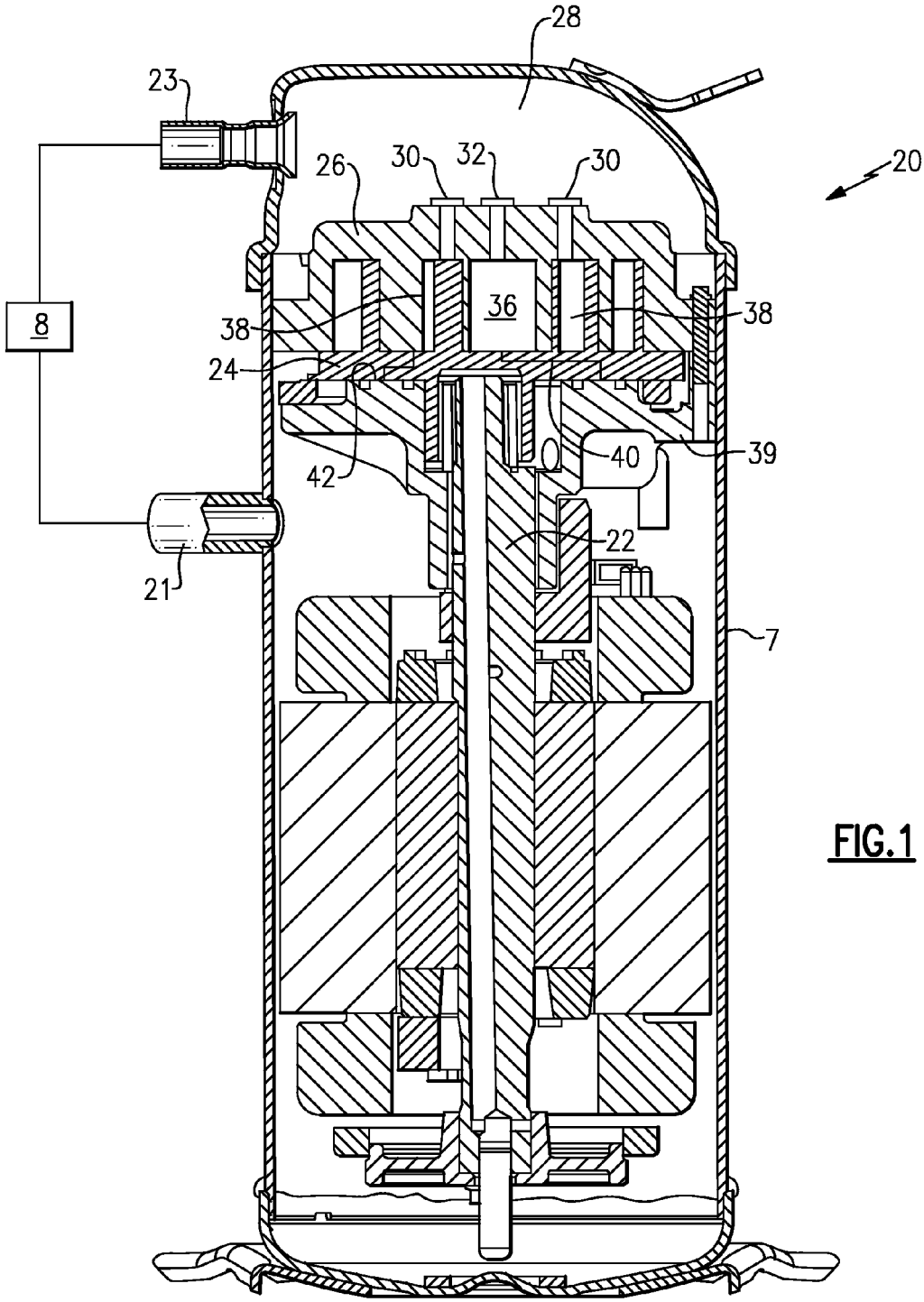
FIG. 1 shows a scroll compressor incorporating this invention.

As shown in FIG. 1, a scroll compressor incorporates a driveshaft 22 rotating about a rotational axis and causing an orbiting scroll member 24 to orbit relative to a non-orbiting scroll member 26. Discharge compression chamber 36 is formed at a central portion of the interfitting wraps of the scroll members 24 and 26. Outer compression chambers 38 are positioned circumferentially outwardly from the chamber 36. A housing 7 encloses the components as described below.

Refrigerant enters from a refrigerant system in through a suction tube 21, and enters the compression chambers at the outer periphery of the wraps of the orbiting scroll member 24. That refrigerant is trapped and compressed, as known. The compressed refrigerant passes through discharge valves 32 and 30, and into a discharge plenum 28. From discharge plenum 28, refrigerant passes through a discharge tube 23, and back into the remainder of the refrigerant cycle 8.

A scroll compressor designer will know that various conditions within the refrigerant system 8 will cause the amount of refrigerant sent to the compressor 20 to vary. Depending on the amount of refrigerant passing through the compressor 20, the compressor may operate at a low pressure ratio or a high pressure ratio. The more refrigerant passing through the compressor, the greater the pressure ratio will be.

As shown in FIG. 1, a back pressure chamber 42 is defined between a crankcase 39 and the back of a base of the orbiting scroll member 24. A tap 40 taps refrigerant from the discharge chamber 36 to this back pressure chamber 40.

Figure 2A:
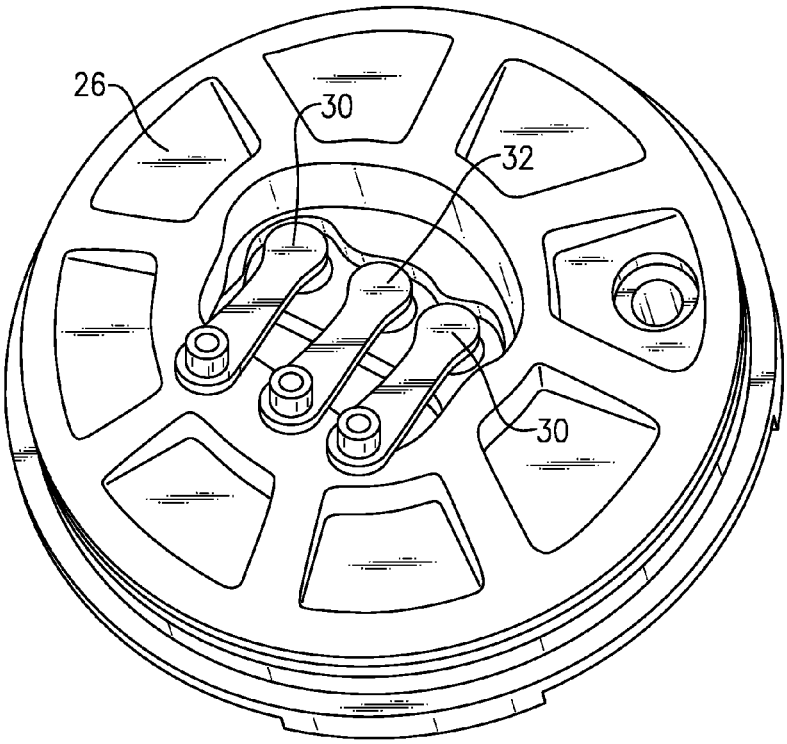
FIG. 2A is a back view of a non-orbiting scroll incorporating the present invention.

As shown in FIG. 2A, valves 30 are positioned outwardly of valve 32. The valves 30 and 32 are disk valves having a back stop, a bolt securing the back stop to the base, and a biased valve member intermediate the base of the non-orbiting scroll member 26 and the stop. The structure of the valve is as known.

Figure 2B:
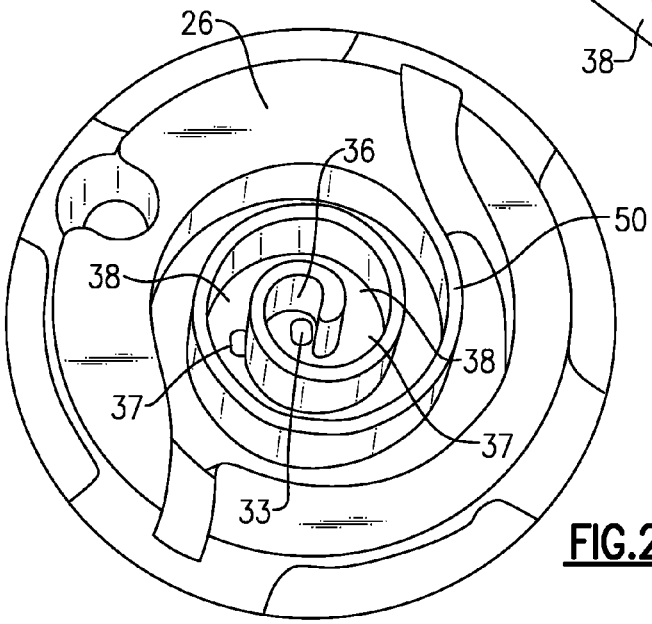
FIG. 2B is an opposed view of the FIG. 2A non-orbiting scroll.

FIG. 2B shows the chambers 36 and 38 on the non-orbiting scroll member 26. As shown, ports 37 extend from the chamber 38 to the discharge plenum 28. Port 33 extends from the central chamber 36 to the discharge plenum 28.

Figure 3:
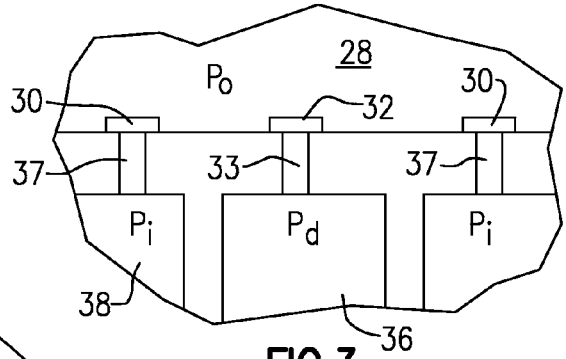
FIG. 3 is a cross-sectional detail of the present invention.

As shown in FIG. 3, the valves 32 and 30 close off the chambers 38 and 36, and the ports 33 and 37. An intermediate pressure $P_i$, could be said to exist in the chamber 38. A discharge pressure $P_d$ could be said to exist in the chamber 36.

The pressure $P_0$ existing in the chamber 38 controls when the valves 30 will open to provide low pressure ratio operation, or when the valves 30 remain closed such that a high pressure $P_d$ is reached, passing all refrigerant through the port 33 and the valve 32. This operation will be self-regulating.

Figure 4A:
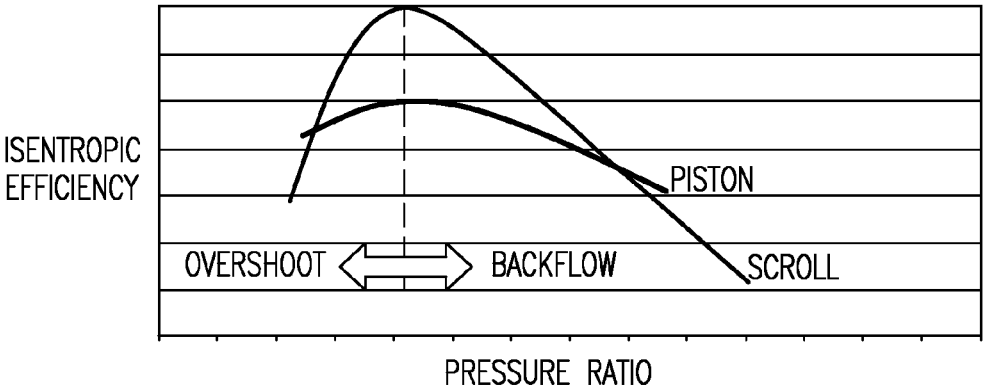
FIG.4A Prior Art
FIG. 4A shows a graph of a prior art problem.
Figure 4B:
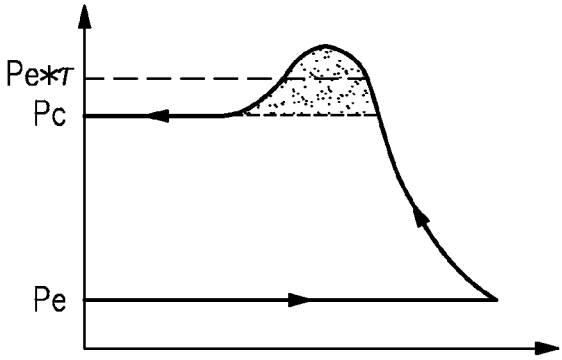
FIG.4B Prior Art
FIG. 4B shows a graph of one of the prior art problems shown in FIG. 4A.
Figure 4C:
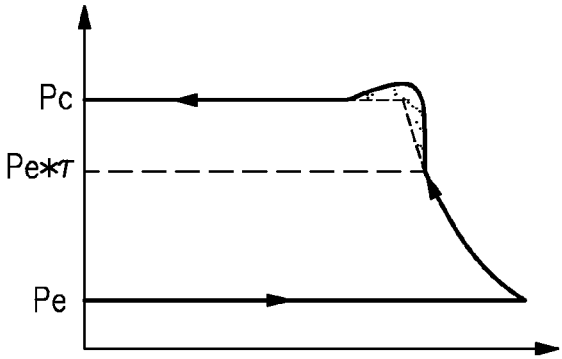
FIG.4C Prior Art
FIG. 4C shows another prior art problem illustrated in FIG. 4A.
Figure 5:
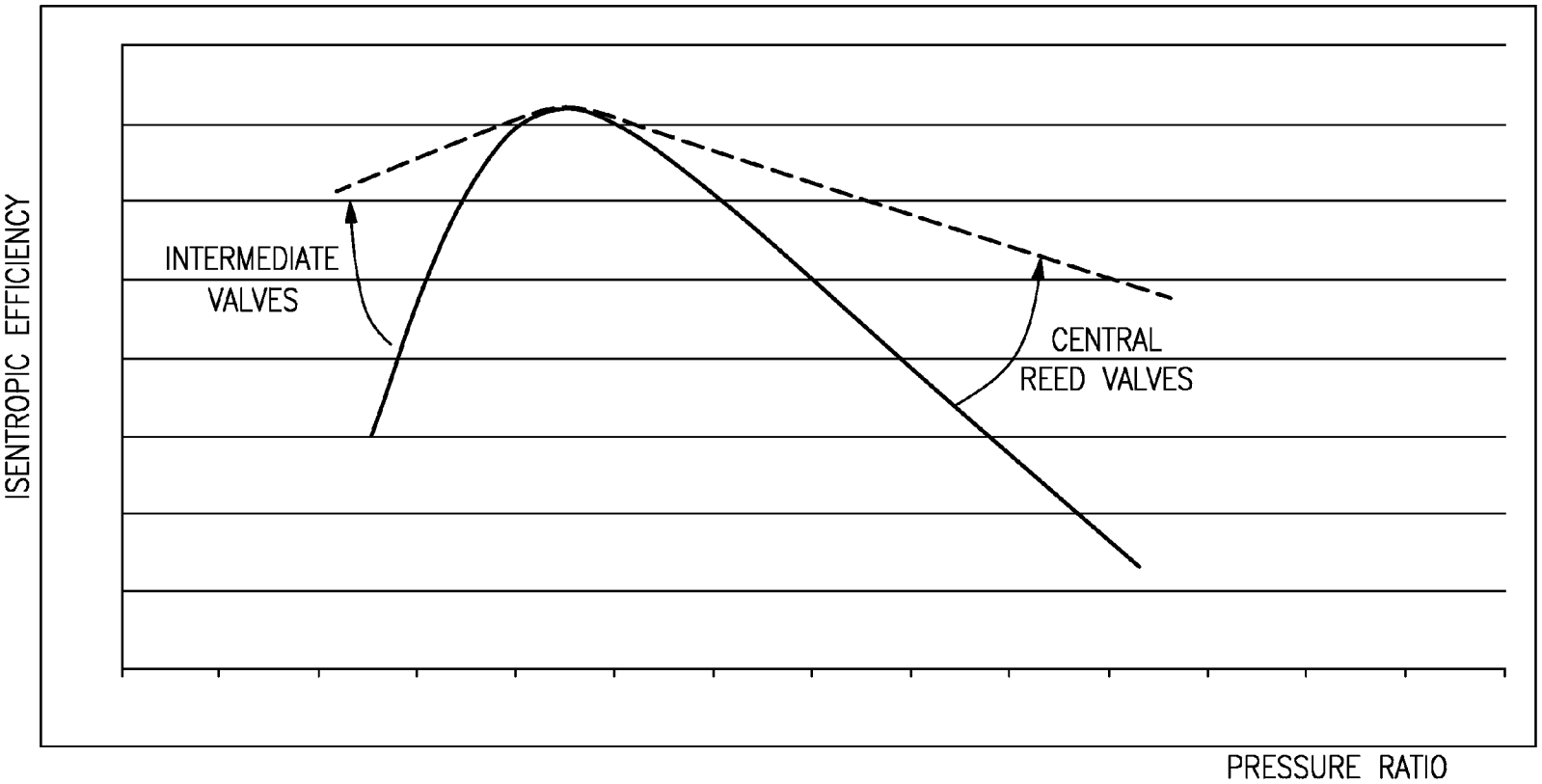
FIG. 5 shows improvements with the present invention.

The provision of the valves 30 does eliminate the overshoot as mentioned in FIG. 4B.

In addition, when the compressor does operate to achieve the high pressure $P_d$, the tapping of the discharge pressure refrigerant to the back pressure chamber prevents the separation and back flow problem as mentioned above.

While the back pressure chamber is illustrated behind the base of the orbiting scroll, it is also known to provide a back pressure chamber behind the base of the non-orbiting scroll in scroll compressors where the non-orbiting scroll can move axially. In addition, while the tap 40 is shown extending through the base of the orbiting scroll 24, it could also extend from other locations, such as through the non-orbiting scroll 26, and/or the housing 39. This invention in its broadest aspects would extend to these and any number of other options.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A scroll compressor comprising:

a housing enclosing a compressor pump unit including an orbiting scroll member and a non-orbiting scroll member, each of said orbiting and non-orbiting scroll members including a base and a generally spiral wrap extending from said base, said wraps interfitting to define compression chambers, with a central-most discharge pressure chamber, and circumferentially spaced intermediate pressure chambers being defined;

the base of said non-orbiting scroll including ports associated with said intermediate pressure chambers, and at least one port associated with said discharge pressure chamber, and valves associated with each of said ports, a discharge plenum defined downstream of said ports and said valves, and within said housing; and a back pressure chamber defined behind said base of one of said orbiting and non-orbiting scroll members, said back pressure chamber tapping a refrigerant from said discharge pressure chamber.

2. The scroll compressor as set forth in claim 1, wherein said back pressure chamber is defined behind said base of said orbiting scroll member.

3. The scroll compressor as set forth in claim 2, wherein said tap extends through said base of said orbiting scroll member.

* * * * *